United States Patent [19]

Sorenson

[11] 4,430,534

[45] Feb. 7, 1984

[54] SWITCH CONSTRUCTION

[75] Inventor: Richard W. Sorenson, Avon, Conn.

[73] Assignee: Carlingswitch, Inc., West Hartford, Conn.

[21] Appl. No.: 475,953

[22] Filed: Mar. 16, 1983

Related U.S. Application Data

[63] Pat. No. 4,389,352, which is a division of Ser. No. 234,664, Feb. 17, 1981, Pat. No. 4,347,417.

[51] Int. Cl.[3] ..... H01H 5/06

[52] U.S. Cl. ..... 200/68.3; 200/241; 200/250

[58] Field of Search ..... 200/676, 68, 241, 250, 200/260, 275

[56] References Cited

U.S. PATENT DOCUMENTS 3,636,286 1/1972 Hults ..... 200/676

3,643,051 2/1972 Foley ..... 200/275

4,389,552 6/1983 Sorenson ..... 200/68

*Primary Examiner*—John W. Shepperd

*Attorney, Agent, or Firm*—McCormick, Paulding & Huber

[57] ABSTRACT

A plastic switch actuator is fitted with a spring so as to impart sliding and rocking motion to a movable contact by virtue of direct engagement between spring and element. The actuator has a depending integral portion received in an opening of the element but it is the spring which keeps the element in contact with the fixed switch contacts. Other embodiments provide for a switch actuator having a movable contact element capable of retention in a "center-off" position wherein the movable contact is held in a stable "off" position in contact with only the center contact. The movable element is readily moved by the depending actuator portion through joint action by the actuator and the spring provided on said actuator.

3 Claims, 3 Drawing Figures

SWITCH CONSTRUCTION

CROSS REFERENCE TO RELATED APPLICATIONS

This application is a continuation-in-part of Ser. No. 328,828 filed Dec. 9, 1981 and issued June 21, 1983 under U.S. Pat. No. 4,389,552, as a division of Ser. No. 234,664 filed Feb. 17, 1981 now U.S. Pat. No. 4,347,417 dated Aug. 31, 1982. The disclosure in said related patents is incorporated by reference herein.

This invention relates generally to electrical switches and deals more particularly with a "center-off" switch construction having the same actuator and spring motion of my earlier patent but with the spring so connected to the movable contact element that a stable "center-off" switch condition is achieved.

FIG. 1 is a sectional view similar to FIG. 18 of U.S. Pat. No. 4,347,417 but showing an alternative contact configuration capable of stable "center-off" as in the switch shown in FIGS. 12–20 of U.S. Pat. No. 4,347,417.

Turning now to the drawings in U.S. Pat. No. 4,347,417, FIGS. 10–19 illustrate that the actuator and spring invention can be utilized in a toggle switch of the type disclosed in prior art U.S. Pat. No. 3,158,704 and others, and that the invention is not limited to the environment of a rocker type switch such as that shown and described above with reference to prior art U.S. Pat. No. 3,711,663. It will be apparent to those skilled in the art that the present invention can also be adapted to other style switches, including but not limited to slide switches and the like.

DETAILED DESCRIPTION OF NEW MATTER (FIGS. 1–3)

Figure 1:
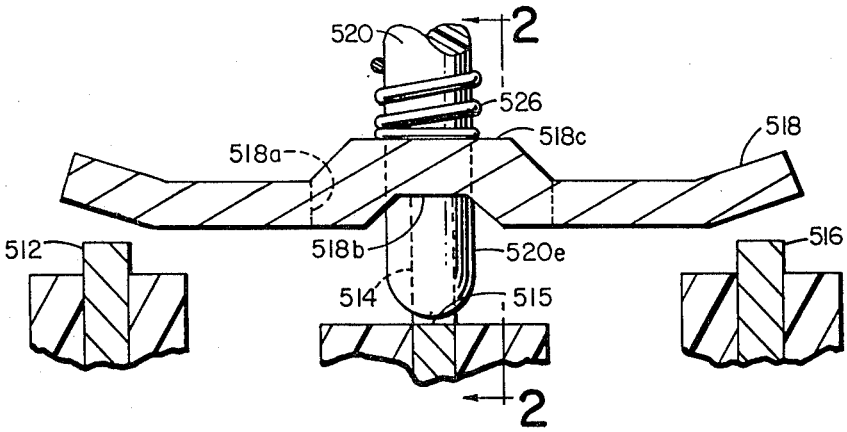

FIG. 1 illustrates a "center-off" switch similar to that of FIGS. 12–19 of U.S. Pat. No. 4,347,417 and FIG. 1 herein differs from FIG. 18 of said patent only to the extent necessary to illustrate the unique geometry of the fixed center contact 514, the movable contact element 518, and the spring 526. These components are so designed that the necessity for the plastic shelf **410*b* shown in FIG. 12** of the patent is eliminated.

It has been found that the upper end of the metal contact 414 in the switch shown in FIGS. 12–19 of the patent tends to wear away faster than the plastic shelf **410*b* due to the continuous contact with the movable element 418**, and that this situation can ultimately lead to lack of switch "on" condition in some cases of excessive switch cycling.

Figure 2:
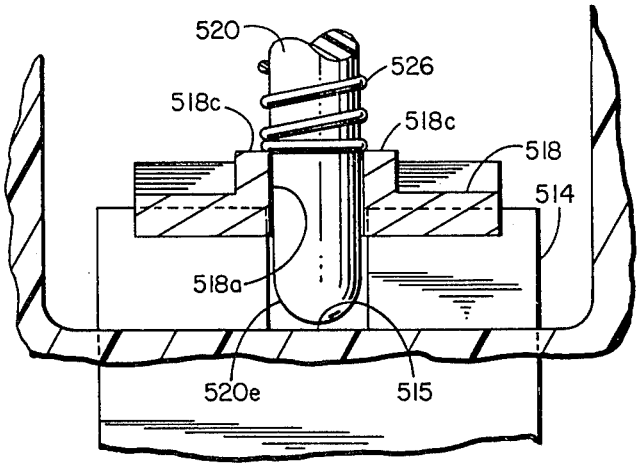
FIG. 2 is a sectional view taken on the line 2—2 of FIG. 1.
Figure 3:
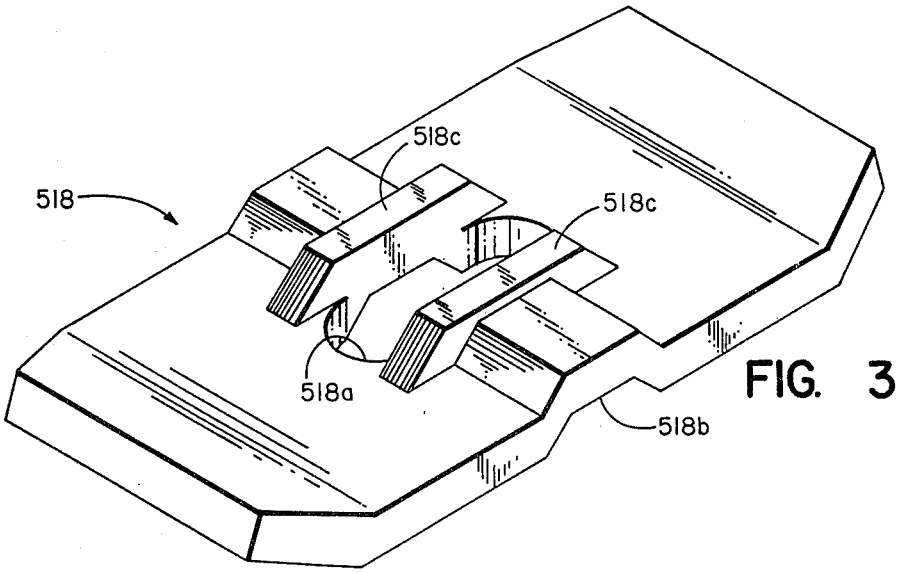
FIG. 3 is a perspective view of the FIG. 1 contact element.

To cure this problem I have eliminated the plastic shelf altogether in the switch of FIGS. 1–3 and I have provided the structure for achieving a stable "center-off" switch condition by providing flat lands **518*c*, 518*c* on the raised portions of the movable contact element 518 so that the "squared-off" lower end of spring 526 will hold this element 518 in the FIG. 1** "center-off" position shown.

The movable element 518 is otherwise similar to the element 418 described previously with reference to the "center-off" switch of FIGS. 12–19 in the patent. That is, element 518 also has a center opening **518*a* to receive the depending post portion 520*e* for achieving movement of the element 518 in response to pivotal or sliding motion of the actuator 520**.

As best shown in FIG. 3, the movable element 518 also has a recess **518*b* in it's lower wall defined in part on opposite sides of the opening 518*a*. This recess 518*b*, 518*b* receives the upper end of the fixed center contact 514 and provides the reactive surface for the biasing force of the spring 526 as it holds movable element 518 in the "center-off" position shown in FIG. 1**.

The spring 526 has a flat lower end, and a diameter of at least twice the thickness of the flat fixed contact 514. The extent of the flat lands **518*c*, 518*c* of element 518 is preferably somewhat greater than this coil spring diameter as suggested in FIG. 1. This geometry does not adversely effect the sliding and rocking motion of the movable element 518 as it is shifted to the left (or right) and out of the "center-off" position shown to "on" position(s) wherein the element 518 is in contact with fixed contact 512 (or contact 516). It will also be apparent that the "center-off" geometry described and claimed herein can be adapted for use in a rocker switch as shown in my U.S. Pat. No. 4,347,417 a toggle switch as shown in FIGS. 12–19** of said patent and as claimed in the divisional case, now issued under U.S. Pat. No. 4,389,552 or a slide switch as shown in my pending application Ser. No. 341,706.

I claim:

1. A "center-off" switch comprising a base defining an upwardly open cavity, at last three fixed contacts spaced along the bottom wall of said cavity, said switch having means defining actuator support regions, an actuator including support means cooperating with said support regions to movably support said actuator, said actuator including a depending post portion, a movable contact element slidably received inside said base cavity for movement generally across the upper ends of said fixed contacts to selectively bridge certain of them, said movable element having at least one upwardly open recess to receive the lower end of said actuator post portion, said element being moved in response to actuator movement, a spring retained by said actuator post portion to bias said element toward said fixed contacts, said fixed contacts including a center contact with an upper end shaped to receive a central recess in the underside of said element in a "center-off" element position wherein said other fixed contacts do not engage said movable contact element, and said element having generally flat lands on either side of said actuator post recess for engagement with the lower end of said spring, said spring lower end also being generally flat to provide a stable "center-off" position for said movable element.

2. The switch according to claim 1 wherein said movable contact element recess for receiving said depending actuator end portion comprises an opening through said contact element, said depending portion being loosely received in said opening to permit rocking motion of said contact element as it moves over one of said fixed contacts, said one fixed contact having a planar upstanding portion so oriented that it's uppermost edge engages the underside of said movable contact element, and said depending actuator end portion adapted to move through the plane of said upstanding portion during movement of said contact element responsive to said actuator movement.

3. The switch according to claim 2 wherein said center contact comprises a flat metal strip with it's upper end slotted to provide clearance for said actuator post portion, said spring comprising a coil with a diameter at least twice the thickness of said flat center contact.

* * * * *